US005262110A

United States Patent [19]

Spaller, Jr. et al.

[11] Patent Number: 5,262,110

[45] Date of Patent: Nov. 16, 1993

[54] APPARATUS AND METHOD FOR SPINNING FILAMENTS

[75] Inventors: Albert E. Spaller, Jr., Johnson City; C. Kit Begley, Kingsport; Robert G. Casper, Kingsport; Shen S. Chen, Kingsport, all of Tenn.; Bobby D. Duncan, Abingdon, Va.; Glen R. Keith, Gray, Tenn.; Junior H. Landes II; Andrew E. McLeod, both of Kingsport, Tenn.

[73] Assignee: Eastman Kodak Company, Rochester, N.Y.

[21] Appl. No.: 922,934

[22] Filed: Jul. 31, 1992

[51] Int. Cl.[5] ..... D01D 5/04; D01F 2/30

[52] U.S. Cl. ..... 264/207; 264/211.14; 264/211.15; 425/72.2; 425/378.2; 425/382.2; 425/464

[58] Field of Search ..... 264/205, 207, 211.14, 264/211.15; 425/72.2, 326.1, 378.2, 382.2, 464

[56] References Cited

U.S. PATENT DOCUMENTS 3,080,611 3/1963 Jarrett et al. ..... 264/207 X 3,111,368 11/1963 Romano ..... 264/205

*Primary Examiner*—Leo B. Tentoni

*Attorney, Agent, or Firm*—John F. Stevens; William P. Heath, Jr.

[57] ABSTRACT

Apparatus and method are disclosed for spinning filaments from a material such as cellulose acetate dope. The filaments are spun from a spinnerette at the top of a vertically elongated spinning cabinet. Gas is first directed parallel to the filaments as they are spun. A short distance down the cabinet, gas is directed radially inwardly toward the filaments. The two flows of gas merge and flow parallel to the filaments to the bottom of the cabinet, where the gas is withdrawn radially outwardly from the filaments.

7 Claims, 3 Drawing Sheets

APPARATUS AND METHOD FOR SPINNING FILAMENTS

TECHNICAL FIELD

This invention relates to apparatus and method for spinning filaments. It is especially suitable for spinning cellulose acetate dope into filaments which are used as tow for articles such as, for example, cigarette filters.

BACKGROUND OF THE INVENTION

Synthetic yarn filaments are traditionally produced by melt, wet or dry spinning techniques, each being very well known in the art. For the production of cellulose acetate filaments, the dry spinning technique has been utilized quite successfully in the past. That is, a solution (usually called a "dope") comprising cellulose acetate and a volatile solvent therefor (usually acetone) is typically extruded through spinnerettes into a gaseous medium which serves to volatilize and evaporate the solvent thereby forming filaments of cellulose acetate. Usually multiple filaments are extruded, gathered into a tow and made into a filter rod, which is subsequently used for cigarette filters in a manner well known in the art. Spinning, volatilization and evaporation normally occur in a vertical chamber commonly referred to as a cabinet.

At present, the gaseous medium is introduced into the spinning cabinets in such a way as to produce much turbulence and disturbance of the filament bundle which results in undesirable defects in the to band. This invention discloses an apparatus and method to introduce and retrieve this warm process gas so as to minimize these defects and maximize the heat and mass transfer between the tow and process gas.

DESCRIPTION OF THE INVENTION

According to the present invention, there is provided a method of forming a filament bundle from a spinning solution comprising the steps of a) providing a substantially enclosed, vertically elongated spinning cabinet with at least on spinnerette near the uppermost part thereof, b) spinning a multiplicity of filaments from a spinning solution through the spinnerette in a vertically downward direction, c) directing a first stream of warm gas in a downward direction around the filaments as they emerge from the spinnerette whereby solvent diffuses from within the filaments to the surfaces thereof and is volatilized, and whereby the filaments begin to individually solidify and strengthen, d) directing a second stream of warm gas radially inwardly and into the filament bundle at an entrance spaced an appreciable distance downward from the spinnerette, whereby diffusion and volatilization of solvent and solidification of the filaments is continued, e) removing both the first and second streams of warm gas at a position adjacent the exit of the filaments from the cabinet in a generally radial outward direction, and f) providing a pressure differential between the top and bottom of the cabinet to maintain the flow of gas in a downward direction.

Also, according to the present invention there is provided apparatus for forming a filament bundle from a spinning solution comprising a) a substantially enclosed, vertically elongated spinning cabinet having at least one spinnerette at the uppermost part thereof, b) means for spinning a multiplicity of filaments from a spinning solution from the spinnerette in a vertically downward direction, c) means for directing a first stream of warm gas in a downward direction around the filaments as they emerge from the spinnerette whereby solvent diffuses from within the filaments to the surfaces thereof and is volatilized, and whereby the filaments begin to individually solidify and strengthen, d) means for directing a second stream of warm gas radially inwardly and into the filament bundle at an entrance spaced an appreciable distance downward from the spinnerette whereby volatilization of solvent and solidification of the filaments is continued, e) means for removing both the first and second streams of warm gas at a position adjacent the exit of the filaments from the cabinet in a generally radial outward direction, and f) means providing a pressure differential between the top and bottom of the cabinet to maintain the flow of gas in a downward direction.

Figure 1:
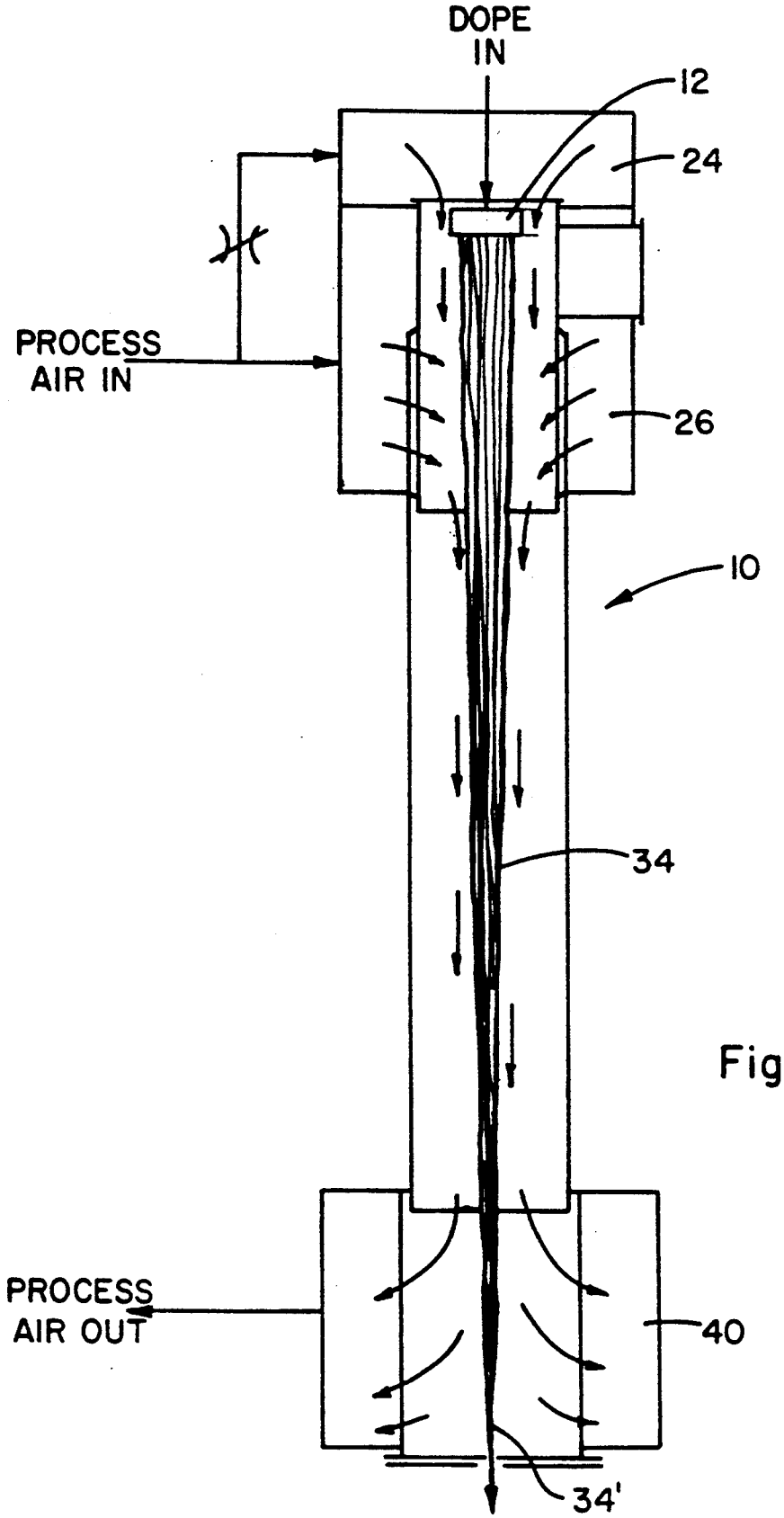
FIG. 1 is a schematic elevational view of the spinning cabinet according to this invention.
Figure 2:
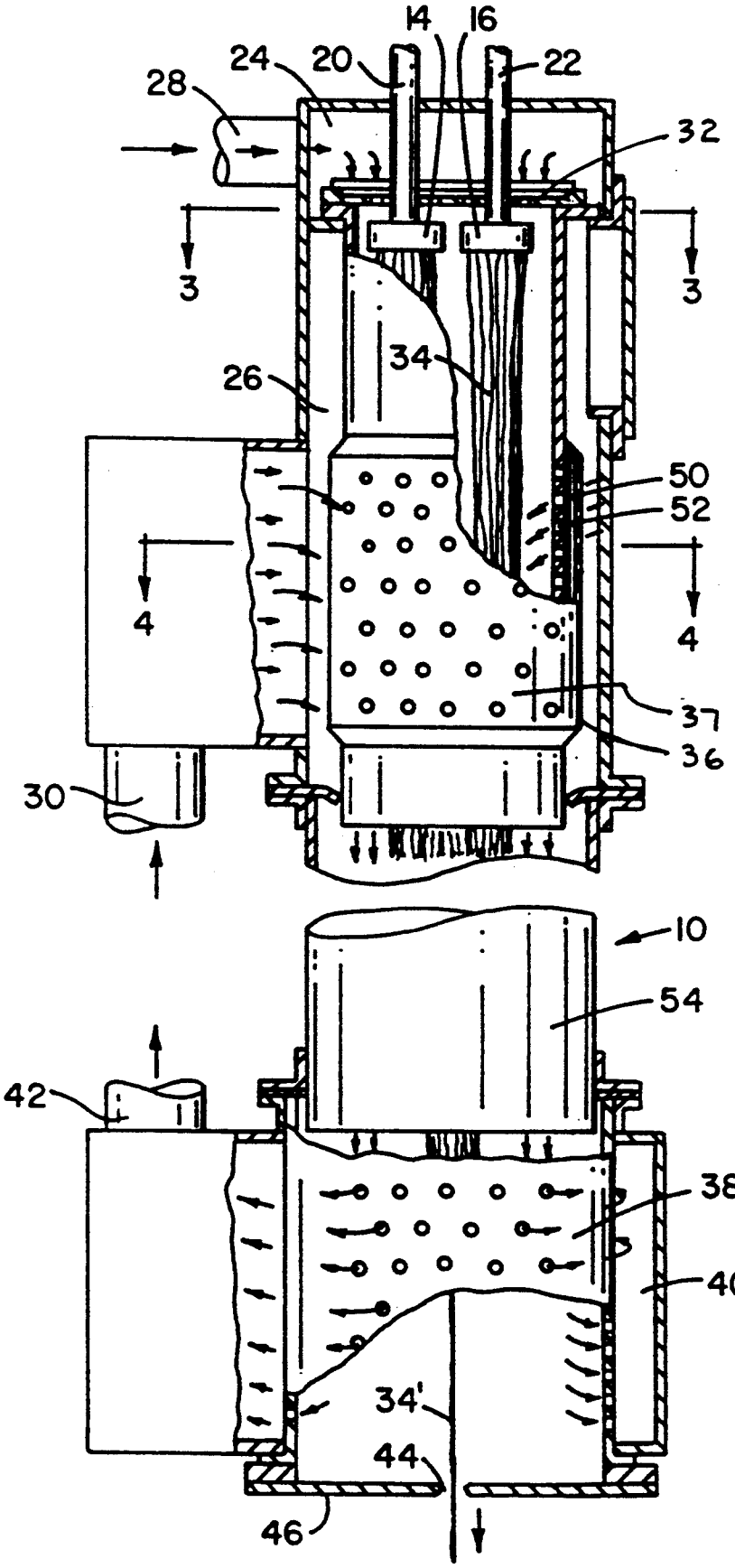
FIG. 2 is an enlarged elevational view in section showing details of the air feed means at the top of the cabinet and the air removal means at the bottom of the cabinet.
Figure 3:
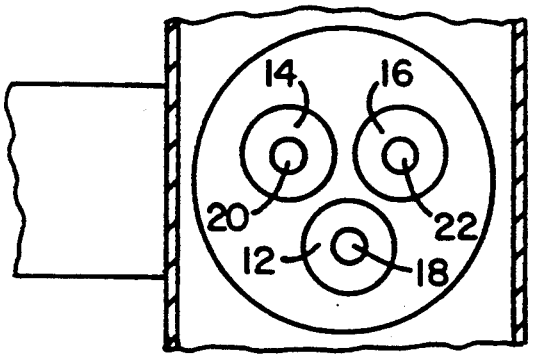
FIG. 3 is a section view along line 3—3 of FIG. 2.
Figure 4:
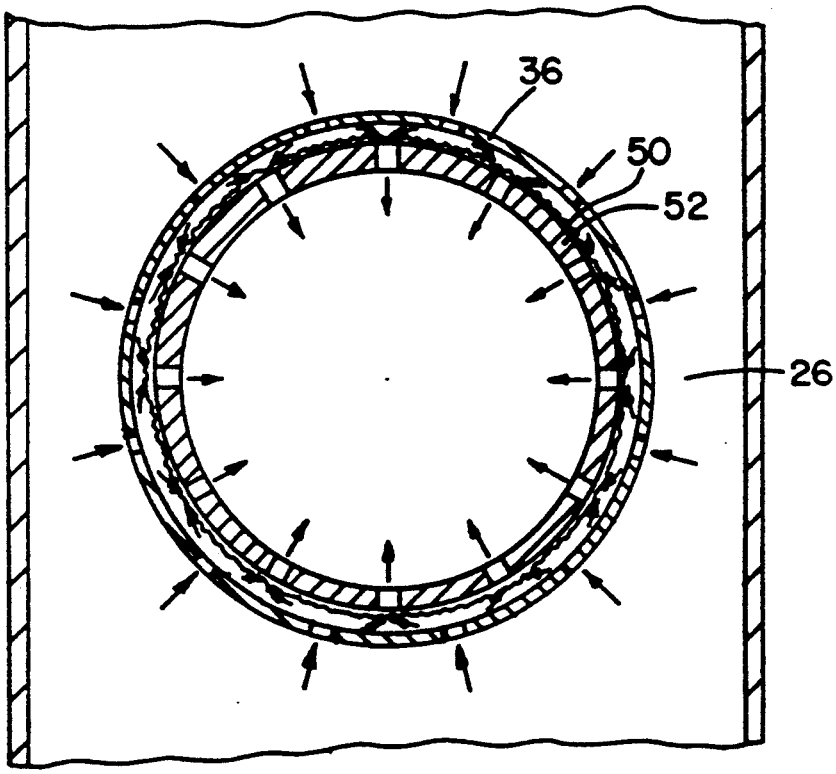
FIG. 4 is a section view along line 4—4 of FIG. 2.

Referring generally to the drawings, the method and apparatus according to the present invention is shown in diagram in FIG. 1. The enclosed, vertically elongated cabinet 10 is provided with at least one conventional spinnerette 12. Three spinnerettes 12, 14 and 16 are illustrated in FIG. 3. These spinnerettes are supplied with spinning solution through conduits 18, 20 and 22 leading thereto. It should be understood that while the term "spinning solution" is used herein, the supply material may also be a molten material. Each of the conventional spinnerettes 12, 14 and 16 have a multiplicity of holes for the solution to emerge. The solution emerges from the holes in each spinnerette in the form of filaments in a vertical direction. As they progress downward, solvent diffuses from within the filaments to the surfaces thereof and is volatilized, whereby the filaments begin to individually solidify and strengthen.

While various inert gases may be used in connection with the present invention to remove solvent from the filaments in cabinet 10, air is preferred and will be used in this description. The top of cabinet 10 is divided into two chambers 24 and 26. Warm air is introduced into both chambers 24 and 26 through conduits 28 and 30 respectively to promote removal of solvent from the filaments to harden them. The warm air promotes the evaporation and diffusion of the solvent, typically acetone. The air introduced into chamber 24 flows through perforated plate 32 in a manner such as to flow in a direction parallel to the movement of filaments 34. The filaments 34 are not influenced by any other air flow until, at a position spaced downwardly from the spinnerettes, air is introduced through the circular distribution sleeve 36 in a radially inward direction. To promote the even distribution of air from chamber 26 to the filaments 34, distribution sleeve 36 includes a circular perforated plate 37 which cooperates with a circular screen 50 and supplemental circular perforated plate 52 on the inside. This air then immediately merges with the air flowing parallel to the filaments, and together flow parallel to the filaments to the bottom of the cabinet, which is at a lower pressure, and is removed in a radially outward direction through perforated circular distribution sleeve 38, into chamber 40, which surrounds sleeve 38, and finally is removed through conduit 42. The converged filaments 34' are now withdrawn from the cabinet through opening 44 in plate 46 by pull rolls, not shown.

Circular cabinet housing 54 provides the main portion of cabinet 10. When the filaments 34 first exit the spinnerette, they are very tender and easily damaged or broken by the least amount of air turbulence. Also, since the temperature of the dope is well above the vapor pressure of solvent at atmospheric pressure, the solvent at or near the surface of the filament is readily flashed off. Therefore, very little heating of the filaments from the warm air is required. Only enough air is required to keep the air/solvent mixture in a safe operating range. At about 10 to 20 inches down from the spinnerette in a typical cellulose ester spinning cabinet, the filaments have hardened somewhat and cooled due to solvent evaporation to where additional warm air is required to maintain a sufficient rate of solvent removal so that the solvent level in the filaments is reduced to the desired level before the filaments exit the cabinet. The hardened filaments are now stronger and can be subjected to stronger and larger air flow. The filaments and warm air travel down the cabinet to the point of exit where the air is removed to be sent to a process for solvent recovery.

The spinning system to produce one tow band normally consists of several spinning cabinets with one or more spinnerettes in each cabinet. Typically, by way of example, the total tow denier is about 39,000 and requires about 4400 scfm of air at 90° C.

The top plenum is divided into two chambers 24 and 26 to provide a means to divide the incoming air into two streams, one for the small amount of gentle air to wash the evaporating acetone during the first part of the cabinet and the other for the larger flow. The small flow must be introduced gently and along the extrusion direction. This flow is about 10% of the total, i.e., the combined quantity introduced through conduits 28 and 30. The remaining flow is introduced radially in the area 26. Even though the filaments have hardened somewhat where the radial flow is introduced, the air must be introduced uniformly and at low velocities to reduce disturbing the filament bundle. This is accomplished by distribution sleeve 36. A layer of close woven wire screen 50 is wrapped around the inner sleeve 52. Around this and slightly spaced away is a perforated circular perforated plate 36. The outer sleeve provides the pressure drop necessary to provide uniform flow, the woven wire screen softens the air velocity and the inner sleeve provides support and large open area. An arrangement such as this is required to produce quality filaments for the tow band. The solvent/air mixture is removed in the lower plenum in a radial fashion through perforated circular plate 38.

Significant advantages of this apparatus include the following:

a) Process air is introduced in two increments. About 10% is introduced above the spinnerettes softly at low velocity and in same direction as filaments flow. This prevents turbulence and stray air currents which could damage the weak filaments. The remaining air flow is introduced radially. The design is such as to provide uniform flow. Also, the design provides a soft radial velocity and no unbalancing turbulent flows.

b) Process air is removed in a radial manner so as to eliminate unbalanced turbulent air flows.

c) Process air flows in the same direction as the filaments (co-current air flow).

d) Arrangement and design result in low cost modular construction with minimum installation labor e) Lightweight sheet metal type fabrication results in a lightweight assembly which results in low floor loadings.

f) Design provides a structure which is free standing.

A slub catcher is provided at opening 44 which is aligned with the opening in the door assembly. Under normal operation, the fiber will only touch the slub catcher guides, not the opening in the bottom door.

The following are specifics for a typical apparatus and method according to this invention:

Material—cellulose acetate dope
Solvent—acetone
Number of spinnerettes per cabinet—3
Number of holes per spinnerette—500
Denier of filaments—3.3
Air temperature, °C.—90–100
Air flow—coaxial—velocity=150–300 ft./min.
Air flow—Radial—velocity=40–60 ft./min.
Circular perforated plates 36 and 38—open area of about 2.5% and about 1/16 inch diameter holes
Circular inner perforated sleeve 52—open area of about 60% and holes about 3/16 in. in diameter The invention has been described in detail with particular reference to preferred embodiments thereof, but it will be understood that variations and modifications can be effected within the spirit and scope of the invention.

We claim:

1. Method of forming a filament bundle from a spinning solution comprising the steps of a) providing a substantially enclosed, vertically elongated spinning cabinet with at least one spinnerette near the uppermost part thereof, b) spinning a multiplicity of filaments from a spinning solution through said spinnerette in a vertically downward direction, c) directing a first stream of warm gas in a downward direction around the filaments so as to flow generally parallel therewith as they emerge from said spinnerette whereby solvent diffuses from within the filaments to the surfaces thereof and is volatilized, and whereby said filaments begin to individually solidify and strengthen, d) directing a second stream of warm gas radially inwardly from a generally circumferential distribution sleeve and into said filament bundle at an entrance spaced an appreciable distance downward from said spinnerette, whereby diffusion and volatilization of solvent and solidification of the filaments is continued, e) removing both said first and second streams of warm gas at a position adjacent the exit of said filaments from said cabinet in a generally radial outward direction, and f) providing a pressure differential between the top and bottom of said cabinet to maintain the flow of both said streams of gas in a downward direction.

2. Method according to claim 1 wherein said spinning solution is cellulose acetate dope.

3. Method according to claim 1 wherein said spinning solution is cellulose acetate dissolved in acetone.

4. Method according to claim 1 wherein said gas is air.

5. Method according to claim 1 wherein said first and second streams of warm gas contain volatilized solvent at the point of removal from said cabinet, said method further comprising the steps of separating at least a portion of solvent from said gas and recirculating at least a portion of said gas as said first and second streams.

6. Apparatus for forming a filament bundle from a spinning solution comprising a) a substantially enclosed, vertically elongated spinning cabinet having at least one spinnerette at the uppermost part thereof, b) means for spinning a multiplicity of filaments from a spinning solution from said spinnerette in a vertically downward direction, c) means for directing a first stream of warm gas in a downward direction around the filaments so as to flow generally parallel therewith as they emerge from said spinnerette whereby solvent diffuses from within the filaments to the surfaces thereof and is volatilized, and whereby said filaments begin to individually solidify and strengthen, d) means for directing a second stream of warm gas radially inwardly from a generally circumferential distribution sleeve and into said filament bundle at an entrance spaced an appreciable distance downward from said spinnerette whereby diffusion and volatilization of solvent and solidification of the filaments is continued, e) means for removing both said first and second streams of warm gas at a position adjacent the exit of said filaments from said cabinet in a generally radial outward direction, and f) means providing a pressure differential between the top and bottom of said cabinet to maintain the flow of both said streams of gas in a downward direction.

7. Apparatus according to claim 6 wherein said means for directing a first stream of warm gas, said means for directing a second stream of gas and said means for removing both said first and second streams of gas each comprise a cylindrical perforated plate for causing a substantially even flow of said gas around said filaments.

* * * * *